US010962202B2

(12) United States Patent
DiFelice et al.

(10) Patent No.: US 10,962,202 B2
(45) Date of Patent: Mar. 30, 2021

(54) ADJUSTABLE LUMINAIRE MOUNTED SENSOR HOUSING

(71) Applicant: SIGNIFY HOLDING B.V., Eindhoven (NL)

(72) Inventors: Eric DiFelice, Aurora, CO (US); Andrew Svendsen, Lakewood, CO (US)

(73) Assignee: SIGNIFY HOLDING B.V., Eindhoven (NL)

( * ) Notice: Subject to any disclaimer, the term of this patent is extended or adjusted under 35 U.S.C. 154(b) by 32 days.

(21) Appl. No.: 16/191,194

(22) Filed: Nov. 14, 2018

(65) Prior Publication Data

US 2020/0149712 A1 May 14, 2020

(51) Int. Cl.

| | |
|---|---|
| ***F21V 17/02*** | (2006.01) |
| ***F21V 21/00*** | (2006.01) |
| ***F21V 23/04*** | (2006.01) |
| *F21Y 115/10* | (2016.01) |
| *F21Y 103/10* | (2016.01) |

(52) U.S. Cl.
CPC ..... *F21V 17/02* (2013.01); *F21V 21/00* (2013.01); *F21V 23/0471* (2013.01); *F21V 23/0464* (2013.01); *F21Y 2103/10* (2016.08); *F21Y 2115/10* (2016.08)

(58) Field of Classification Search
CPC .. F21V 17/02; F21V 23/0471; F21V 23/0464; F21V 21/00
See application file for complete search history.

(56) References Cited

U.S. PATENT DOCUMENTS

| | | | | |
|---|---|---|---|---|
| 9,874,478 | B1 * | 1/2018 | Coombes | G01J 1/06 |
| 10,337,912 | B2 * | 7/2019 | Wright | F21V 17/104 |

* cited by examiner

*Primary Examiner* — Karabi Guharay

(57) ABSTRACT

A sensor assembly includes a sensor housing having an attachment end portion, and a sensor disposed at least partially in the sensor housing. The sensor housing is movably attachable to a luminaire housing of a luminaire. The attachment end portion is designed to be positioned on an edge of the luminaire housing to retain the sensor housing attached to the luminaire housing.

20 Claims, 9 Drawing Sheets

ADJUSTABLE LUMINAIRE MOUNTED SENSOR HOUSING

TECHNICAL FIELD

The present disclosure relates generally to lighting, and more particularly to adjustably attachable sensor housing for lighting fixtures.

BACKGROUND

Some lighting fixtures include one or more sensors. For example, a lighting fixture may include an occupancy sensor, such as a motion sensor or a camera. Some lighting fixtures may include a light sensor or another type of sensor. A sensor attached to a lighting fixture is typically mounted to the housing of the lighting fixture. For example, a sensor of a lighting fixture may be mounted at an opening in the housing of the lighting fixture such that the sensor extends through the opening to have an exposure to a monitored area. Often, a sensor is attached to the housing of the lighting fixture at a fixed location during the manufacturing or assembly of the lighting fixture. However, the fixed location of a sensor may not be a suitable in some cases. For example, the sensor may interfere with the aesthetic appearance of the lighting fixture for some installation spaces. The location of a sensor on a lighting fixture may also be undesirable for effective monitoring of space illuminated by the light provided by the lighting fixture. Generally, changing the location of a sensor that is integrated into a lighting fixture to a different location may be challenging or impractical. Thus, a solution that allows for the flexible placement of a sensor of a lighting fixture before and after installation of the lighting fixture is desirable.

SUMMARY

The present disclosure relates generally to lighting, and more particularly to an adjustably attachable sensor housing for lighting fixtures. In an example embodiment, a sensor assembly includes a sensor housing having an attachment end portion, and a sensor disposed at least partially in the sensor housing. The sensor housing is movably attachable to a luminaire housing of a luminaire. The attachment end portion is designed to be positioned on an edge of the luminaire housing to retain the sensor housing attached to the luminaire housing.

In another example embodiment, a lighting device includes a luminaire that includes a luminaire housing having a side panel. The lighting device may also include a sensor assembly that includes a sensor housing and a sensor. The sensor is disposed at least partially in the sensor housing. The sensor housing is movably attached to the side panel of the luminaire housing. The sensor housing is positioned outside of the luminaire housing.

In another example embodiment, a lighting device includes a luminaire that includes a luminaire housing having a side panel. The side panel includes an upper segment, a lower segment, and a channel between the upper segment and the lower segment. The lighting device also includes a sensor assembly that includes a sensor housing and a sensor, where the sensor is disposed at least partially in the sensor housing. The sensor housing is movably attached to the side panel. An attachment structure protruding out from a wall of the sensor housing extends into the channel. The sensor housing is positioned outside of the luminaire housing.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 2:
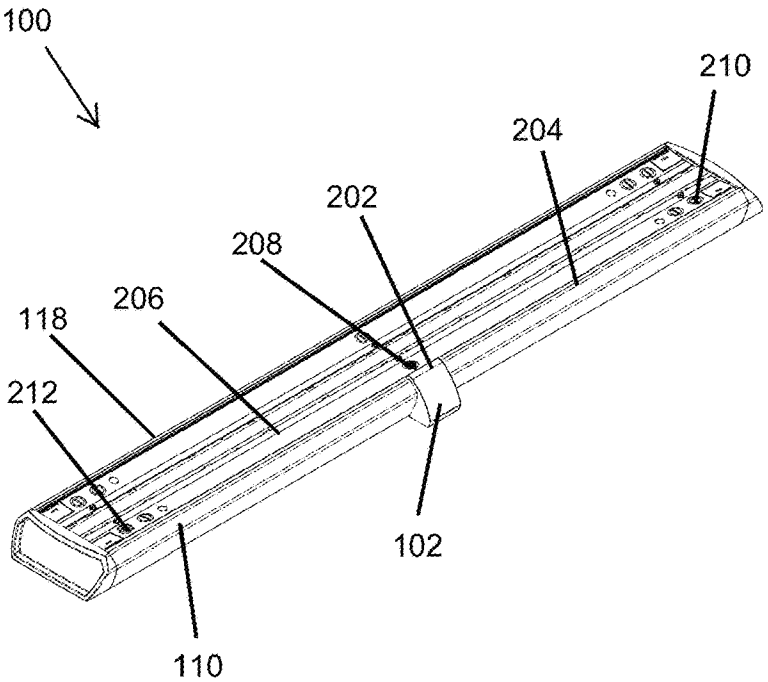
FIG. 2 illustrates a top perspective view of the luminaire with the sensor assembly of FIG. 1 according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals used in different drawings designate like or corresponding but not necessarily identical elements.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

In some example embodiments, a sensor housing may be mounted on the side of a luminaire in such a way to allow for adjustability along the edge of the luminaire. The adjustment of the location of a sensor housing may be useful for functional and/or aesthetic purposes. For example, adjusting the location of a sensor housing may be done to achieve a desired or improved occupancy sensing area coverage or daylight sensing by a sensor housed in the sensor housing. Adjustability of the location of the sensor housing may also allow the sensor housing to be placed at a less conspicuous location.

For linear lighting fixtures, the adjustable sensor housing may be located along a length of the lighting fixture with no or minimal interference with the lighting function of the lighting fixture. For a lighting fixture with a continuous bottom diffuser lens, the adjustable sensor housing allows the sensor to be anywhere along the length of the lighting fixture without interrupting the lens.

The adjustable sensor housing may be attached to the side of a lighting fixture by means such as hooks, clips, a groove, slots, fasteners, magnets, and by other means that allow for adjustably mounting the sensor housing at various locations of a lighting fixture. A sensor that is housed in the adjustable sensor housing may be electrically connected via a wired or wireless connection.

Figure 1:
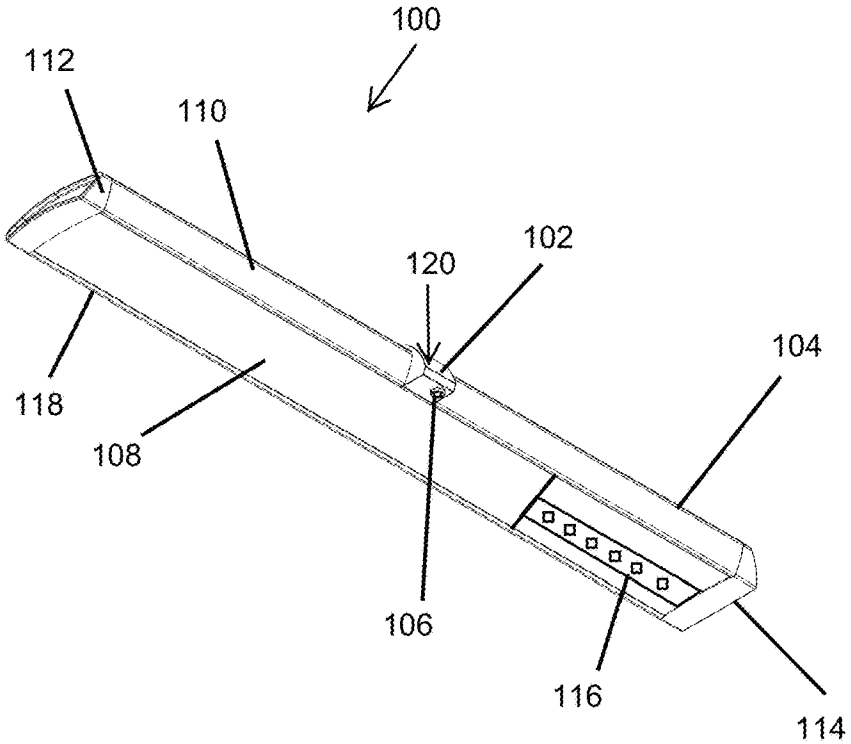
FIG. 1 illustrates a bottom perspective view of a luminaire with a positionally adjustable sensor assembly according to an example embodiment.

Turning to the drawings, FIG. 1 is a bottom perspective view of a luminaire 100 with a positionally adjustable sensor assembly 120 according to an example embodiment. The luminaire 100 may be a linear luminaire such as a suspended luminaire. For example, a lighting device may include the luminaire 100 and the sensor assembly 120. In some example embodiments, the luminaire 100 includes a luminaire housing 104 and a lens 108 that covers a light source 116 attached to the luminaire housing 104. In FIG. 1, a portion of the lens 108 is shown removed from the luminaire housing 104 to more clearly show the light source 116. For example, the light source 116 may be a light emitting diode (LED) light source. The light emitted by the light source 116 passes through the lens 108 to illuminate an area below the luminaire 100 when the luminaire 100 is installed (e.g., suspended from a ceiling or another structure).

In some example embodiments, the luminaire housing 104 may include a side panel 110 that is on a first longitudinal side of the luminaire 100 and a side panel 118 that is on an opposite longitudinal side of the luminaire 100. The luminaire housing 104 may also include end caps 112, 114 that are on opposite ends of the luminaire 100. The side panels 110, 118 extend between the end caps 112, 114.

In some example embodiments, the sensor assembly 120 includes the sensor housing 102 and a sensor 106 that is at least partially disposed in the sensor housing 102. The sensor 106 may be positioned to monitor an area below the luminaire 100 for a particular condition (e.g., an occupancy, daylight, etc.). For example, the sensor 106 may include one or more of an occupancy sensor, a carbon monoxide sensor, a smoke detector, a carbon dioxide sensor, a humidity sensor, or an air quality sensor.

For example, the luminaire 100 may control the operation of the light source 116 based on sensing or detection of a particular condition by the sensor 106. In some alternative embodiments, sensing or detection information from the sensor 106 may be transmitted by the sensor 106 or by the luminaire 100 to a remote device. For example, the sensor 106 and/or the luminaire 100 may include a communication component (e.g., a transmitter, etc.) that can transmit the sensing or detection information from the sensor 106.

In some example embodiments, the sensor 106 may be disposed inside the sensor housing 102 such that a portion of the sensor 106 extends through an opening in the sensor housing 102. For example, the sensor 106 may be positioned on a side of the housing 102 that faces the monitored area. In some alternative embodiments, the sensor 106 may be attached to the sensor housing 102 on the outside of the sensor housing 102.

In some example embodiments, the sensor housing 102 may be attached to the luminaire housing 104 on the outside of the luminaire housing 104. For example, the sensor housing 102 may be attached to the side panel 110 of the luminaire housing 104. The sensor housing 102 may be positioned such that the sensor assembly 120 does not interfere with the illumination light provided by the light source 116 to an area below the luminaire 100. For example, the sensor housing 102 may be attached to the side panel 110 at a position that is laterally adjacent to the side panel 110.

In some example embodiments, the sensor housing 102 may be attached to the side panel 110 and positioned generally halfway between the end caps 112, 114. Alternatively, the sensor housing 102 may be attached to the side panel 110 at a different location between the end caps 112, 114. For example, the sensor assembly 120 including the sensor housing 102 may be attached to the side panel 110 at a desired location when the sensor housing 102 gets attached to the side panel 110. Alternatively, the sensor housing 102 may be moved to a desired location between the end caps 112, 114 after the sensor housing 102 is attached to the side panel 110. For example, the sensor housing 102 may be moved to a desired location along the side panel 110 by sliding the sensor housing 102 after the sensor housing 102 is attached to the side panel 110. The sensor housing 102 may also be moved to a desired location along the side panel 110 by detaching the sensor housing 102 from the side panel 110 and attaching the sensor housing 102 back to the side panel 110 at the desired location.

The sensor assembly 120 allows for the placement of the sensor 106 at a location that can provide more effective sensing/detection by the sensor 106. The sensor assembly 120 also provides the flexibility to position the sensor 106 at the time of installation or after installation of the luminaire 100. The sensor assembly 120 also allows for positioning the sensor 106 at a desired location without the need to remove knockouts or otherwise altering the luminaire housing 104 on a side of the luminaire 100 that is viewable from below the luminaire 100.

In some example embodiments, the sensor housing 102 may be made from plastic, metal, and/or another suitable material using methods such as molding, etc. For example, the sensor housing 102 may be made by assembling multiple walls of the sensor housing 102 using fasteners, an adhesive, etc. to attach adjacent walls to each other. In some example embodiments, the luminaire housing 104 may also be made from plastic, metal, and/or another suitable material. Hooks, clips, groove, slots, fasteners, magnets, and/or by other means may be used in addition to or instead of the attachment end portion 202 to adjustably attach the sensor housing 102 to the luminaire housing 104. For example, one or more fasteners that can be removed to move the sensor housing 102 to a different location may be used. As another example, a magnet may be disposed inside the sensor housing 102, and the magnet may magnetically attach the sensor housing 102 to the side panel 110 that may be made from a metal or that may include a magnet. Alternatively, one or more magnets may be disposed inside luminaire housing 104 at the side panel 110 and may magnetically attach the sensor housing 102 to the side panel 110.

In some alternative embodiments, the sensor assembly 120 may be attached to the side panel 118 instead of the side panel 110. In some alternative embodiments, multiple sensor assemblies may be attached to the luminaire housing 104.

For example, another one of the sensor assembly 120 may be attached to the side panel 118. In some alternative embodiments, the luminaire housing 104 may have a different shape than shown without departing from the scope of this disclosure. In some alternative embodiments, the sensor assembly 120 including the sensor housing 102 may have a different shape than shown without departing from the scope of this disclosure. In some alternative embodiments, the sensor 106 may be at a different location than shown without departing from the scope of this disclosure. In some alternative embodiments, the lens 108 may be omitted without departing from the scope of this disclosure. In some alternative embodiments, the luminaire 100 may include a different type of light source than shown without departing from the scope of this disclosure.

FIG. 2 is a top perspective view of the luminaire 100 with the sensor assembly 120 of FIG. 1 according to an example embodiment. Referring to FIGS. 1 and 2, in some example embodiments, the sensor housing 102 includes an attachment end portion 202 that rests on a top edge 204 of the side panel 110 of the luminaire housing 104. For example, the attachment end portion 202 may be curved or angled such that the attachment end portion 202 fits over the top edge 204 of the side panel 110, thus vertically retaining the sensor housing 102. To illustrate, a tip portion of the attachment end portion 202 may extend beyond the top edge 204 of the side panel 110 toward the end panel 118. The top edge 204 of the side panel 110 can serve as rail for sliding the sensor assembly 120 along the length of the side panel 110 to change the location of the sensor assembly 120.

In some example embodiments, the luminaire housing 104 of the luminaire 100 includes a back cover 206. The back cover 206 is typically on a side of the luminaire 100 that faces a ceiling when the luminaire 100 is suspended from the ceiling. For example, the back cover 206 may extend between the side panels 110, 118 and between the end caps 112, 114.

In some example embodiments, an electrical cable may be routed between the sensor assembly 120 and a compartment of the luminaire 100 through an opening 208 of the back cover 206. To illustrate, the opening 208 can provide a pathway for routing an electrical cable (e.g., one or more electrical wires) between the sensor assembly 120 and a compartment of the luminaire 100. The compartment of the luminaire 100 may be bound by the back cover 206 on the back side of the luminaire 100. The compartment may be used to house electrical wires and components such as a power supply, a controller, communication components, etc.

In some example embodiments, an electrical cable may be routed between the sensor assembly 120 and the compartment of the luminaire 100 through another opening in the back cover 206 instead of or in addition to the opening 208. For example, the back cover 206 may include removable sections 210, 212 (e.g., knockout sections) that can each be removed to provide a respective opening in the back cover 206. To illustrate, the removable section 210 may be removed to provide an opening if the sensor assembly 120 is attached to the side panel 110 closer to the removable section 210. If the sensor assembly 120 is attached to the side panel 110 closer to the removable section 212, the removable section 212 may be removed to provide an opening for routing an electrical cable between the sensor assembly 120 and the compartment of the luminaire 100. In general, a particular removable section, such as the removable sections 210, 212, may be removed depending on the location of the sensor assembly 120 to provide an opening in the back cover 206 that is close to the sensor assembly 120.

By providing an opening in the back cover 206 close to the location of the sensor assembly 120, the length of an electrical cable that is outside of the luminaire housing 104 can be minimized. The availability of removable sections, such as the removable sections 210, 212, in the back cover 206 provides the flexibility to place the sensor assembly 120 at a desired location along the side panel 110 and the side panel 118.

In some alternative embodiments, the back cover 206 may include fewer or more removable sections or openings than shown without departing from the scope of this disclosure. In some alternative embodiments, the back cover 206 may have a different shape or may be made from multiple pieces without departing from the scope of this disclosure.

Figure 3:
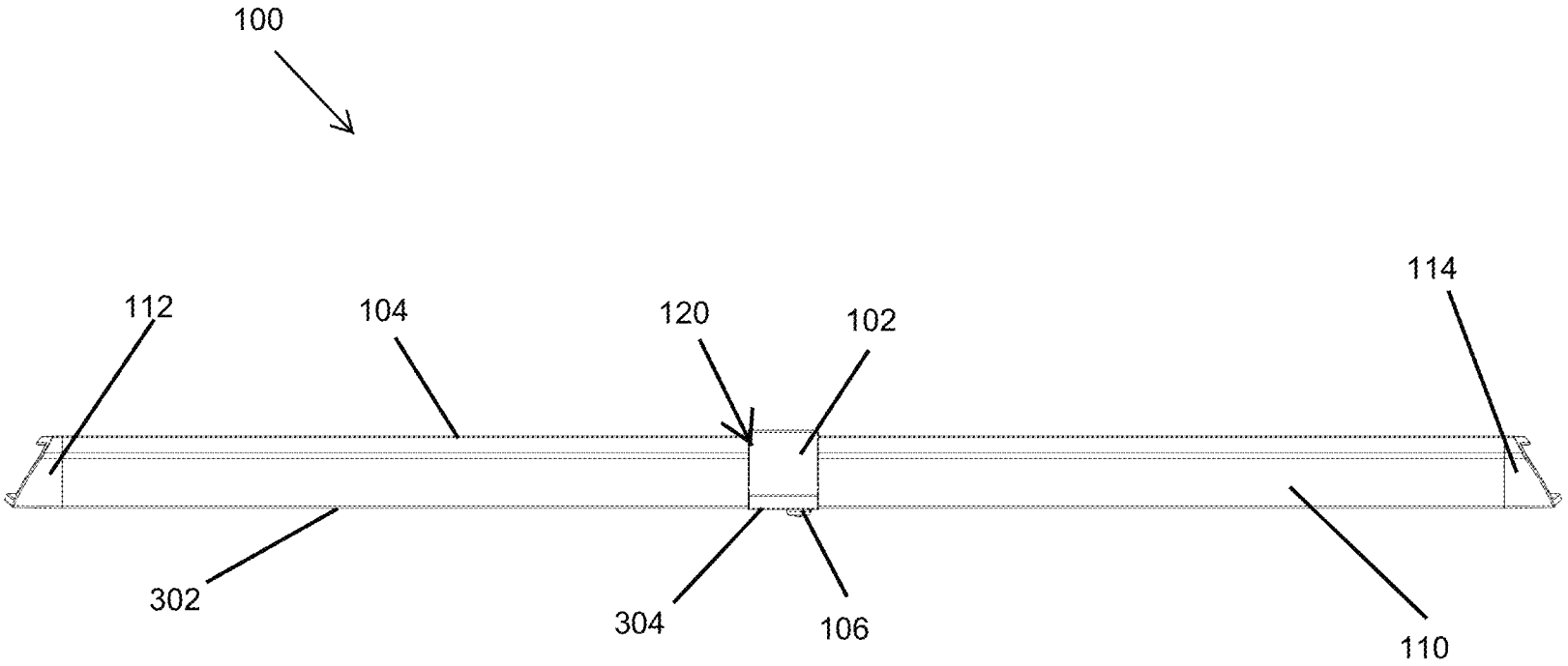
FIG. 3 illustrates a longitudinal side view of the luminaire of FIG. 1 according to an example embodiment.

FIG. 3 is a longitudinal side view of the luminaire 100 with the sensor assembly 120 of FIG. 1 according to an example embodiment. Referring to FIGS. 1-3, in some example embodiments, the sensor assembly 120 may be positioned such that the light provided by the luminaire 100 can illuminate an area with minimal or no interference by the sensor assembly 120. For example, a bottom wall 304 of the sensor housing 102 may be at the same level as a bottom edge 302 of the side panel 110. Because the sensor housing 102 is laterally adjacent to the side panel 110 and because the light provided by the luminaire 100 exits the luminaire housing 104 below the bottom edge 302 of the side panel 110, the sensor housing 102 is generally outside of the path of the light exiting the luminaire housing 104.

In some example embodiments, the sensor 106 may be positioned to monitor the area below the luminaire 100. To minimize or avoid interference of the luminaire housing 104 with the operation of the sensor 106, the sensor 106 may extend to below the bottom edge 302 of the side panel 110, which allows the sensor 106 to have a field of view that is unobstructed by the luminaire housing 104.

In some alternative embodiments, the sensor assembly 120 may be located lower or higher than the bottom edge 302 of the side panel 110 with minimal or no interference with the light provided by the luminaire 100.

Figure 4:
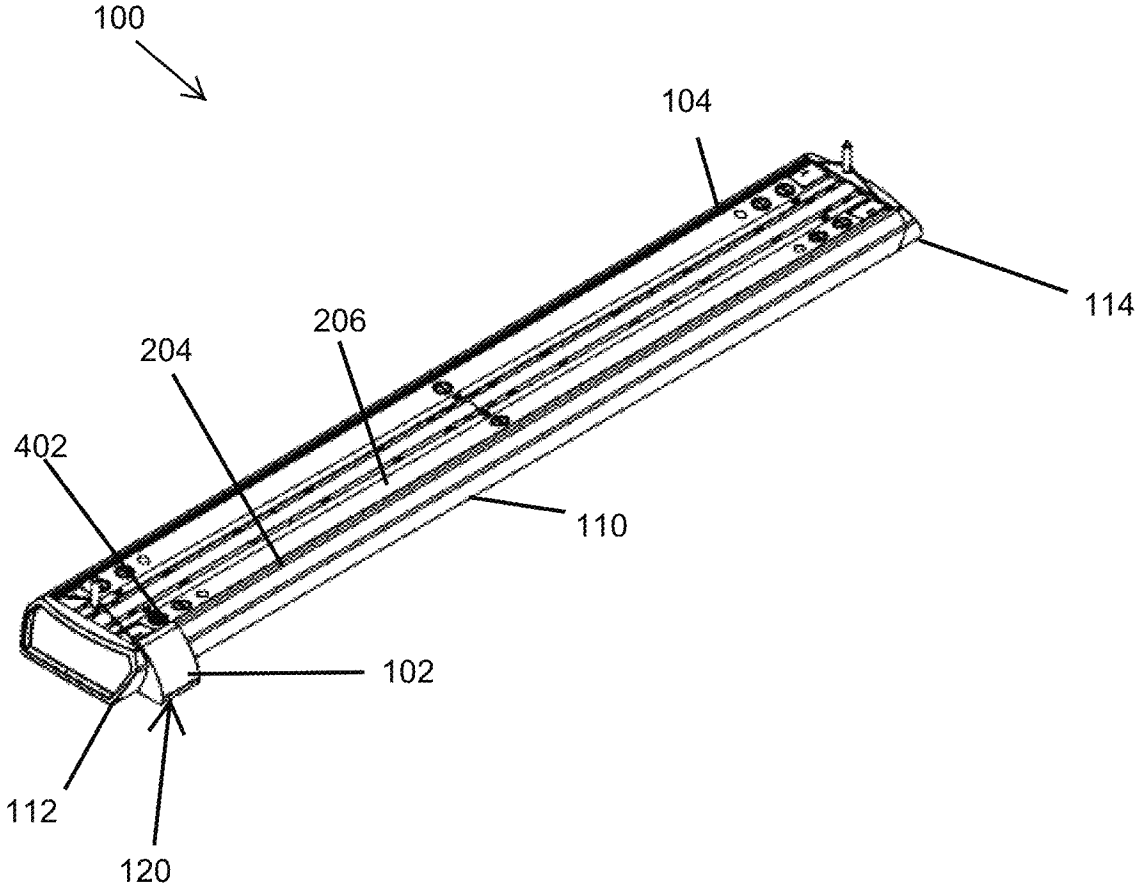
FIG. 4 illustrates a top perspective view of the luminaire of FIG. 1 with the sensor assembly in a different position according to an example embodiment.

FIG. 4 is a top perspective view of the luminaire of FIG. 1 with the sensor assembly in a different position than show in FIG. 1 according to an example embodiment. Referring to FIGS. 1-4, in some example embodiments, the sensor housing 102 may be attached to the side panel 110 at the position shown in FIG. 4. Alternatively, the sensor housing 102 may be moved to the position shown in FIG. 4 from the position shown in FIG. 1 or from another position. For example, the sensor housing 102 may be slid along the top edge 204 of the side panel 110 from the position shown in FIG. 1 to the position shown in FIG. 4 without fully or partially detaching the sensor housing 102 from the side panel 110.

In some example embodiments, an electrical cable may be routed to the sensor assembly 120 through an opening 402 in the back cover 206. For example, the opening 402 may be formed in the back cover 206 by removing the removable section 212 shown in FIG. 2.

In some alternative embodiments, the sensor assembly 120 may be located at a different location than shown in FIG. 4 without departing from the scope of this disclosure. For example, the sensor assembly 120 may be located between the positions shown in FIG. 1 and FIG. 4 or another location that allows for an effective monitoring of a condition in an area.

Figure 5:
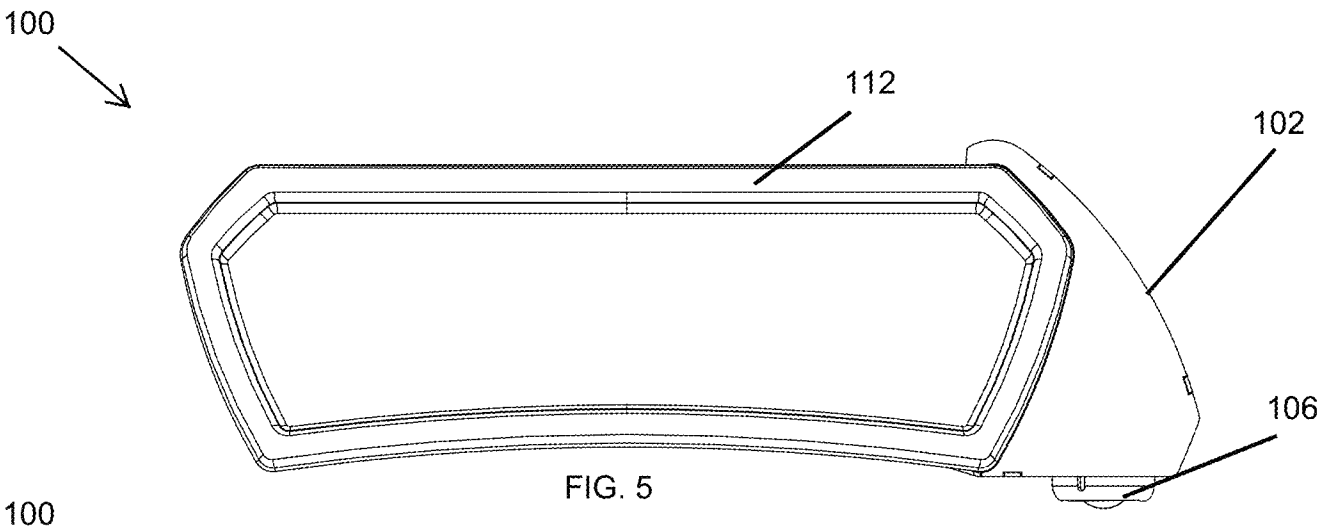
FIG. 5 illustrates a narrow side view of the luminaire with the sensor assembly of FIG. 1 according to an example embodiment.
Figure 6:
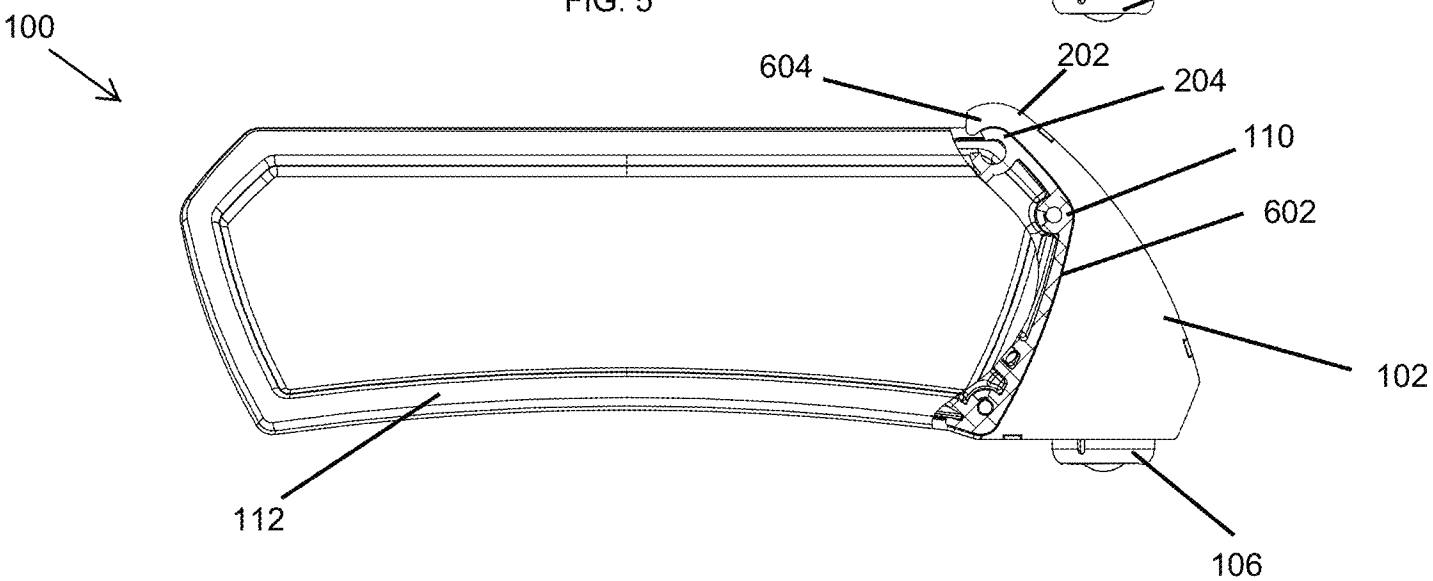
FIG. 6 illustrates another narrow side view of the luminaire with the sensor assembly of FIG. 1 according to an example embodiment.

FIG. 5 illustrates a narrow side view of the luminaire 100 with the sensor assembly 120 of FIG. 1 according to an example embodiment. FIG. 6 illustrates another narrow side view of the luminaire of FIG. 1 with the end cap 112 partially removed for illustrative purposes according to an example embodiment. Referring to FIGS. 1-6, in some example embodiments, the sensor housing 102 may have a wall 602 that is shaped to match the profile of the side panel 110. For example, the sensor housing 102 may be attached to the side panel 110 such that at least a portion of the wall 602 is in contact with the side panel 110.

In some example embodiments, a tip portion 604 of the attachment end portion 202 of the sensor housing 102 may extend beyond the top edge 204 of the side panel 110. For example, the attachment end portion 202 that ends at the tip portion 604 may be curved down such that its curved portion is positioned over the top edge 204 of the side panel 110. The top edge 204 may serve as a rail for sliding the sensor housing 102 to change the position of the sensor housing 102 along the length of the side panel 110.

In some alternative embodiments, the sensor housing 102 may have a different shape than shown without departing from the scope of this disclosure. In some alternative embodiments, a portion of the wall 602 may be spaced from the side panel 110 by a gap. In some alternative embodiments, the side panel 110 may have a different profile than shown without departing from the scope of this disclosure.

Figure 7:
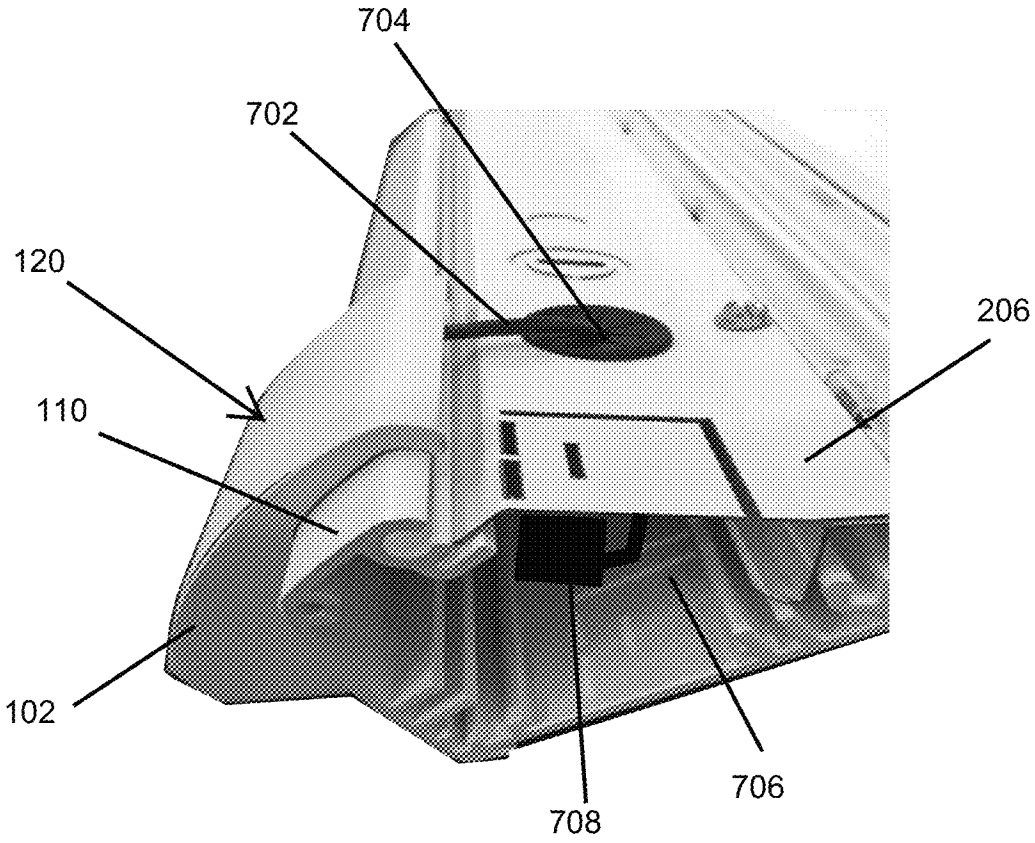
FIG. 7 illustrates a partial narrow side view of the luminaire with the sensor assembly of FIG. 1 without an end cap according to an example embodiment.

FIG. 7 illustrates a partial narrow side view of the luminaire 100 with the sensor assembly 120 of FIG. 1 without an end cap according to an example embodiment. Referring to FIGS. 1-7, in some example embodiments, an electrical cable 702 may extend between the sensor assembly 120 and a compartment 706 of the luminaire housing 104 through an opening 704 in the back cover 206 of the luminaire housing 104. A grommet may be placed at the opening 704 to protect the electrical cable 704 from damage due to direct contact with the edge of the opening 704.

In some example embodiments, the electrical 702 may include one or more electrical wires than can be used to provide power to the sensor 106. To illustrate, one or more electrical wires of the electrical cable 702 may be connected to a power supply 708. One or more electrical wires of the electrical cable 702 may also be connected to another component such as a controller, a communication component, etc.

In some example embodiments, the electrical cable 702 may be long enough to allow the sensor assembly 120 to be positioned farther away from the opening 704 than shown in FIG. 7. For example, the sensor housing 102 may be slid to a different location or may be detached from and reattached to the side panel 110 at a different location while the electrical cable 702 is attached to the sensor assembly 120. A portion of the electrical cable 702 may be routed through the opening 704 on the outside of the compartment 706 to the location of the sensor assembly 120. In some alternative embodiments, the electrical cable 702 or another electrical cable that is connected to the power supply 708 may be routed through another opening in the back cover 206 that is closer to the sensor assembly 120 than the opening 704.

In some alternative embodiments, the luminaire housing 104 and the sensor housing 102 may have different shapes than shown without departing from the scope of this disclosure. In some alternative embodiments, the power supply 708 may be positioned in the compartment 706 at a different location than shown without departing from the scope of this disclosure.

Figure 8A:
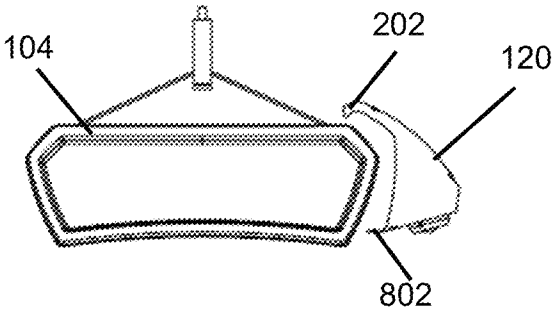
FIGS. 8A-8C illustrate different stages of the attachment of the sensor assembly to the luminaire according to an example embodiment.
Figure 8B:
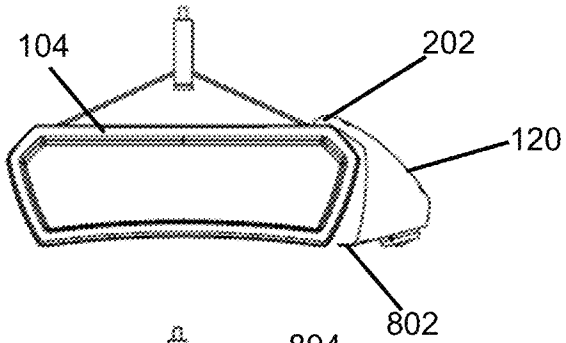
Figure 8C:
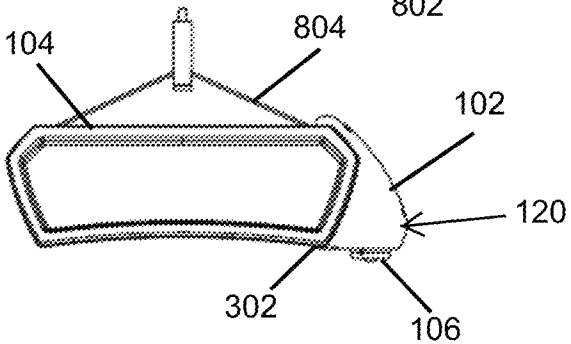

FIGS. 8A-8C illustrate different stages of the attachment of the sensor assembly 120 to the luminaire 100 according to an example embodiment. Referring to FIGS. 1-8C, to attach the sensor assembly 120 to the sensor housing 102, the sensor assembly 120 is moved closer to the side panel 110 as shown in FIG. 8A. For example, the sensor housing 102 may be tilted such that the attachment end portion 202 of the sensor housing 102 is above the top edge 204 of the side panel 110 while an attachment protrusion 802 of the sensor assembly 120 is laterally adjacent to the side panel 110.

In FIG. 8B, the attachment end portion 202 is positioned on the top edge 204 of the side panel 110 while the attachment protrusion 802 remains separated from the side panel 110. The sensor assembly 120 may then be rotated to the position shown in FIG. 8C such that the attachment protrusion 802 is positioned below the bottom edge 302 of the side panel 110 while the attachment end portion 202 remains attached to the side panel 110. In some example embodiments, the attachment end portion 202 and the attachment protrusion 802 may retain the sensor assembly 120 attached to the side panel 110. Alternatively or in addition, hooks, clips, groove, slots, fasteners, magnets, and/or by other means may be used to securely attach the sensor assembly 120 to the luminaire housing 104. In some alternative embodiments, the sensor housing 102 be slid onto the side panel 110 at an end of the side panel 110 after removing one of the end caps 112, 114.

Figure 9:
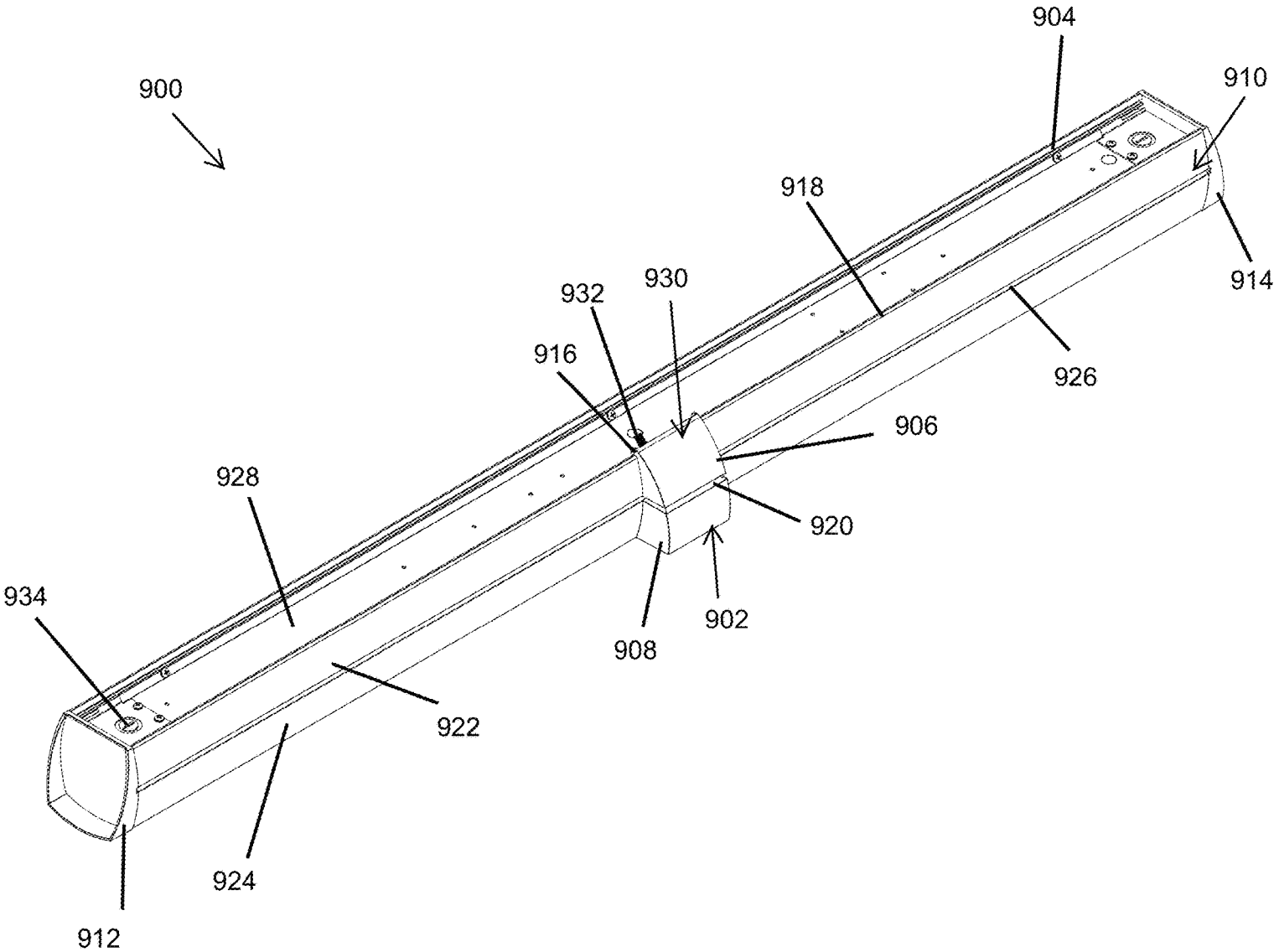
FIG. 9 illustrates a top perspective view of a luminaire with an adjustable sensor assembly according to another example embodiment.

FIG. 9 illustrates a top perspective view of a luminaire 900 with a positionally adjustable sensor assembly 930 according to another example embodiment. The luminaire 900 may be a linear luminaire such as a suspended luminaire. For example, a lighting device may include the luminaire 900 and the sensor assembly 930. In some example embodiments, the luminaire 900 includes a luminaire housing 904 that includes a side panel 910, end caps 912, 914, and a back cover 928. The luminaire 900 may include a lens and a light source such as the lens 108 and the light source 116 shown in FIG. 1.

In some example embodiments, the side panel 910 of the luminaire housing 904 is on a longitudinal side of the luminaire 100 across from another side panel that is on an opposite longitudinal side of the luminaire 900. The side panel 910 may include an upper segment 922, a lower segment 924, and a channel 926 between the upper and lower segments 922, 924. The side panel 910 may include an upper segment 922, a lower segment 924, and a channel 926 between the upper and lower segments 922, 924.

In some example embodiments, the sensor assembly 930 is attached to the side panel 910 as shown in FIG. 9. The sensor assembly 930 may include a sensor housing 902 and a sensor that is at least partially disposed or attached to the sensor housing 902 to monitor for a condition (e.g., a motion, daylight, carbon monoxide, smoke, etc.) in an area where the luminaire 900 is installed. The sensor housing 902 may include an upper segment 906 and a lower segment 908. The upper segment 906 and the lower segment 908 may be at least partially separated by a gap 920 that is generally aligned with the channel 926 of the side panel 910. For example, a cavity of upper segment 906 and a cavity of the lower segment 908 may together form a single cavity of the sensor housing 902 that can be used for containing the sensor as well as other components and wiring.

In some example embodiments, an attachment end portion 916 of the sensor housing 902 extending from the upper segment 906 may be positioned on a top edge 918 of the side panel 910. For example, the attachment end portion 916 may have a curved or hooked shape portion that is positioned on the top edge 918 of the side panel 910 and serves to retain the sensor assembly 930 attached to the side panel 910. The sensor assembly 930 may be attached to the side panel 910 at the location shown in FIG. 9 or may be moved (e.g., slid on the top edge 918 of the side panel 910) from another location on the side panel 910 without detaching the sensor housing 902 from the side panel 910. Alternatively, the sensor assembly 930 may be moved to the location shown in FIG. 9 after detaching the sensor housing 902 from a different location on the side panel 910.

In some example embodiments, an electrical cable may be routed between a compartment of the luminaire housing 904 and the sensor assembly 930 through an opening 932 formed in the back cover 928 in a similar manner as described with respect to the luminaire 100 and sensor assembly 120 of FIG. 1. For example, the electrical cable may include one or more electrical wires that are connected to the sensor assembly 930 and a power supply or another component (e.g., a controller, a communication component, etc.) positioned in the compartment of the luminaire housing 904. The opening 932 or a different opening the back cover 928 may be used to route an electrical cable between the compartment of the luminaire housing 904 and the sensor assembly 930 when the sensor assembly 930 is attached at a different location along the length of the side panel 910 than shown in FIG. 9.

In some example embodiments, the sensor housing 902 may be made from plastic, metal, and/or another suitable material using methods such as molding, etc. For example, the sensor housing 902 may be made by assembling multiple walls of the sensor housing 102 using fasteners, an adhesive, etc. to attach adjacent walls to each other. In some example embodiments, the luminaire housing 904 may also be made from plastic, metal, and/or another suitable material.

The sensor assembly 930 allows for the placement of a sensor housing in the sensor housing 902 at a location that can provide more effective sensing/detection. The sensor assembly 930 also provides the flexibility to position a sensor at the time of installation or after installation of the luminaire 900. The sensor assembly 930 also allows for positioning a sensor at a desired location without the need to remove knockouts or otherwise altering the luminaire housing 904 on a side of the luminaire 900 that is viewable from below the luminaire 900.

In some example embodiments, the sensor housing 902 may be made from plastic, metal, and/or another suitable material using methods such as molding, etc. For example, the sensor housing 902 may be made by assembling multiple walls of the sensor housing 902 using fasteners, an adhesive, etc. to attach adjacent walls to each other. In some example embodiments, the luminaire housing 904 may also be made from plastic, metal, and/or another suitable material using methods known to those of ordinary skill in the art with the benefit of this disclosure.

In some alternative embodiments, the sensor assembly 120 may be attached to the opposite side panel of the luminaire housing 904 instead of the side panel 910. In some alternative embodiments, multiple sensor assemblies may be attached to the luminaire housing 904. In some alternative embodiments, the luminaire housing 904 may have a different shape than shown without departing from the scope of this disclosure. In some alternative embodiments, the sensor assembly 930 including the sensor housing 902 may have a different shape than shown without departing from the scope of this disclosure. In some alternative embodiments, one or more components the luminaire 900 may be omitted without departing from the scope of this disclosure.

Figure 10:
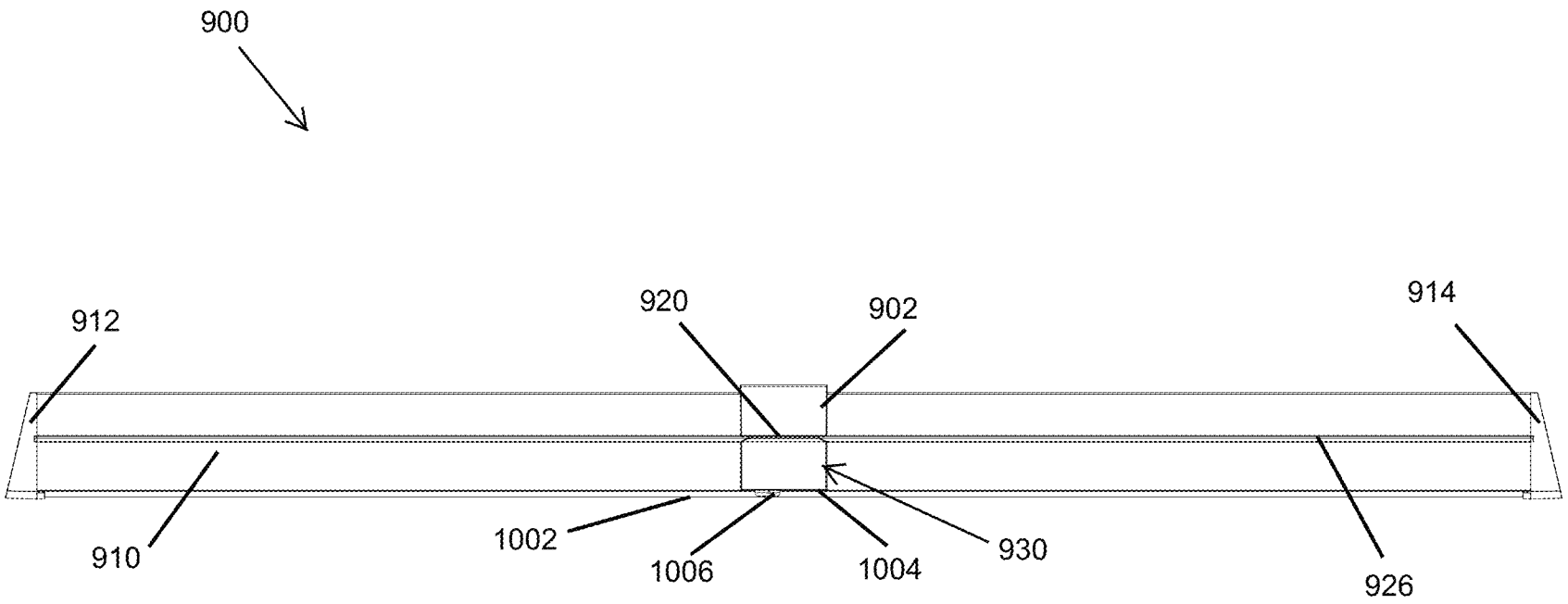
FIG. 10 illustrates a longitudinal side view of the luminaire with the sensor assembly of FIG. 9 according to an example embodiment.

FIG. 10 illustrates a longitudinal side view of the luminaire 900 with the sensor assembly 930 of FIG. 9 according to an example embodiment. Referring to FIGS. 9 and 10, in some example embodiments, the sensor assembly 930 may be attached to the side panel 910 such that the light provided by the luminaire 900 can illuminate an area with minimal or no interference by the sensor assembly 930. For example, a bottom wall 304 of the sensor housing 902 may be above or at the same level as a lens 1002 of the luminaire 900. A sensor 1006 that may be at least partially positioned inside the sensor housing 902 may be above or at the same level as the lens 1002 of the luminaire 900. For example, the sensor 1006 may be the same type as the sensor 106 described above. Because the sensor housing 902 is laterally adjacent to the side panel 910 and because the light provided by the luminaire 900 exits the luminaire housing 904 through the lens 1002 that is at the same level or below the sensor housing 902, the sensor housing 902 is generally outside of the path of the light exiting the luminaire housing 904.

In some example embodiments, the sensor 1006 may be positioned to monitor the area below the luminaire 900. To minimize or avoid interference of the luminaire housing 904 with the operation of the sensor 1006, the sensor 1006 may be at the same level, slightly below or slightly above the lens 1002 of the luminaire 900, which allows the sensor 1006 to have a field of view that is generally unobstructed by the luminaire housing 904.

In some alternative embodiments, the sensor assembly 930 may be located lower or higher than the lens 1002 with minimal or no interference with the light provided by the luminaire 900. In some alternative embodiments, the sensor assembly 930 may be at a different location than shown without departing from the scope of this disclosure.

Figure 11:
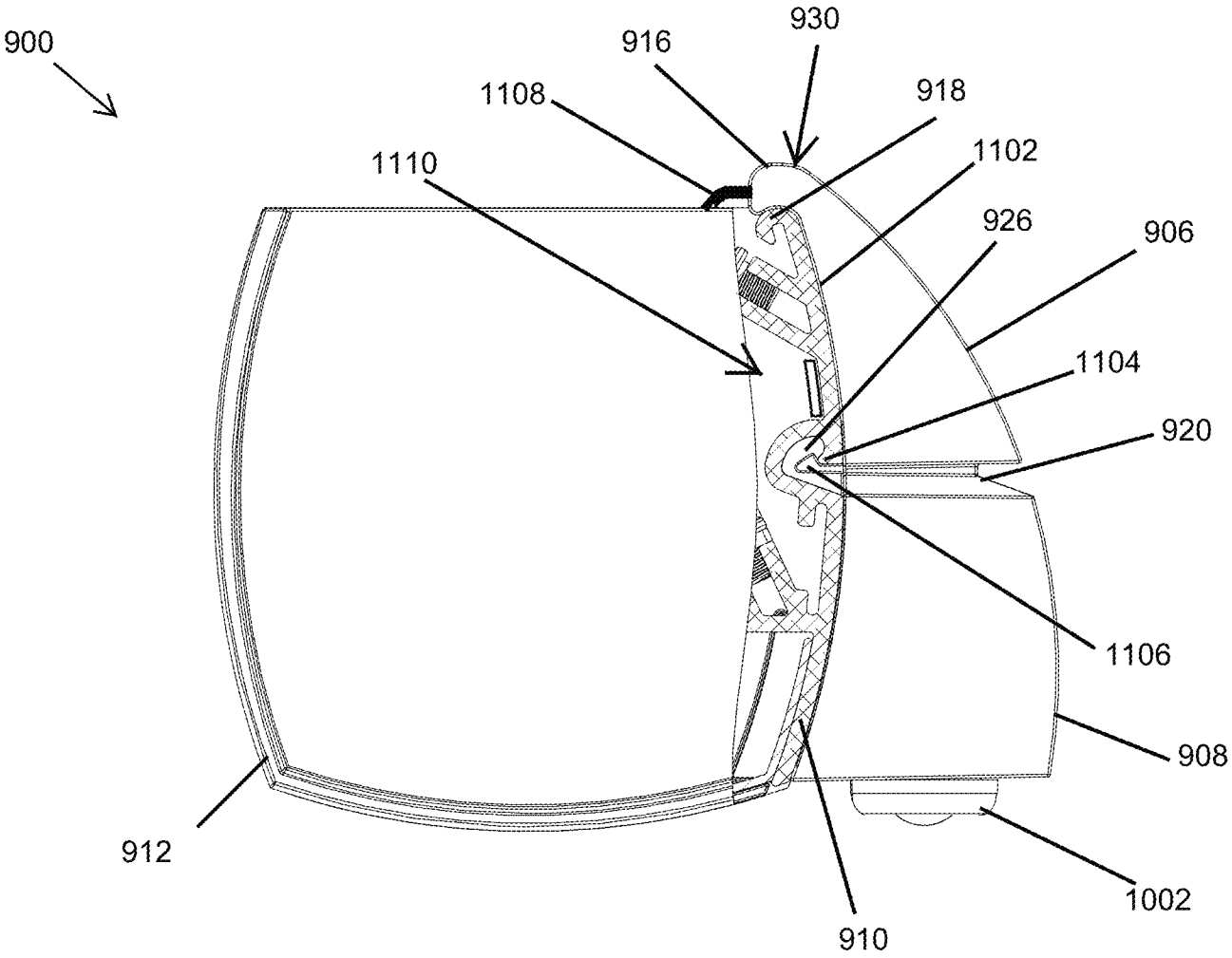
FIG. 11 illustrates a narrow side view of the luminaire with the sensor assembly of FIG. 9 according to an example embodiment.

FIG. 11 illustrates a narrow side view of the luminaire 900 of FIG. 9 with the end cap 912 partially removed for illustrative purposes according to an example embodiment. Referring to FIGS. 9-11, in some example embodiments, the sensor housing 902 may have a wall 1102 that is shaped to match the profile of the side panel 910. For example, the sensor housing 902 may be attached to the side panel 910 such that at least a portion of the wall 1102 is in contact with the side panel 910.

In some example embodiments, the attachment end portion 916 of the sensor housing 902 may extend beyond the top edge 918 of the side panel 910 toward the opposite side panel of the luminaire housing 904 such that a curved portion of the attachment end portion 916 is positioned on the top edge 918. For example, the attachment end portion 916 may be curved downward to hook over the top edge 918 of the side panel 910. To illustrate, the top edge 918 may serve as a rail for sliding the sensor housing 902 to change the position of the sensor housing 902 along the length of the side panel 910.

In some example embodiments, an attachment structure 1106 may protrude out from the wall 1102 of the sensor housing 902 into the channel 926 of the side panel 910. For example, the attachment structure 1106 may have a bump at a tip of the attachment structure 1106. The bump may abut against an edge 1104 of the channel 926 and resist detachment of the attachment structure 1106 from the side panel 910, thus retaining the sensor housing 902 attached to the side panel 910. For example, the attachment structure 1106 may serve to retain the sensor assembly 930 attached to the side panel 910 instead of or in addition to the attachment end portion 916.

In some example embodiments, the attachment structure 1106 may be inserted into the channel 926 at an end of the side panel 910 and the sensor housing 902 may be moved to a desired location along the length of the side panel 910 by sliding the sensor housing 902 to the desired location. In some example embodiments, an electrical cable 1108 may extending between the sensor assembly 930 and a compartment 1110 of the luminaire housing 904 and may include one or more electrical wires for providing power to the sensor 1002 and for communication from and/or to the sensor 1002. For example, one or more electrical wires of the electrical cable 1008 may be coupled to a power supply and/or another component (e.g., a controller, a transmitter, etc.) that is in the compartment 1110.

In some alternative embodiments, the sensor housing 902 may have a different shape than shown without departing from the scope of this disclosure. In some alternative embodiments, a portion of the wall 1002 may be spaced from the side panel 910 by a gap. In some alternative embodiments, the side panel 910 may have a different profile than shown without departing from the scope of this disclosure. In some alternative embodiments, other attachment means such as fasteners, magnets, etc. may be used to adjustably secure the sensor housing 902 to the luminaire housing 904. For example, a magnet that in inside the lower segment 908 or the upper segment 906 may magnetically attach the sensor housing 902 to the side panel 910 that may include a corresponding magnet or may be metal from a magnetic material.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A sensor assembly, comprising:

a sensor housing having an attachment end portion; and a sensor disposed at least partially in the sensor housing, wherein the sensor housing is movably attachable to a luminaire housing of a luminaire, wherein the attachment end portion is designed to be positioned on an edge of the luminaire housing to retain the sensor housing attached to the luminaire housing, and wherein the attachment end portion is designed to hook down onto the edge of the luminaire housing such that a tip of the attachment end portion is below the edge of the luminaire housing when the sensor housing is attached to the luminaire housing.

2. The sensor assembly of claim 1, wherein the sensor housing is attachable to the luminaire housing such that the sensor housing is at a same level or above a bottom lens of the luminaire.

3. The sensor assembly of claim 2, wherein the edge of the luminaire housing is an edge of a side panel of the luminaire housing.

4. The sensor assembly of claim 1, wherein the sensor housing is slidable to change a position of the sensor assembly while the sensor housing is attached to the luminaire housing of the luminaire.

5. The sensor assembly of claim 1, wherein the sensor housing is movably attachable to the luminaire housing laterally adjacent to the luminaire housing.

6. The sensor assembly of claim 1, wherein the sensor housing is movably attachable to the luminaire housing on an outside of the luminaire housing.

7. The sensor assembly of claim 1, wherein the sensor is designed be coupled to a power supply of the luminaire when the sensor assembly is attached to the luminaire housing.

8. A lighting device, comprising:

a luminaire comprising a luminaire housing having a side panel; and a sensor assembly comprising a sensor housing and a sensor, wherein the sensor is disposed at least partially in the sensor housing, wherein the sensor housing is movably attached to the side panel, wherein the sensor housing is positioned outside of the luminaire housing, wherein the sensor is coupled to a power supply of the luminaire by an electrical cable extending between the luminaire housing and the sensor housing through an opening in a back cover of the luminaire housing, and wherein the power supply of the luminaire is positioned in a compartment of the luminaire housing.

9. The lighting device of claim 8, wherein the sensor housing is positioned laterally adjacent to the luminaire housing.

10. The lighting device of claim 8, wherein the sensor housing includes an attachment end portion positioned on a top edge of the side panel.

11. The lighting device of claim 10, wherein the attachment end portion includes a curved portion that is positioned on the top edge of the side panel.

12. The lighting device of claim 8, wherein the sensor housing is slidable to change a position of the sensor assembly while the sensor housing is attached to the side panel.

13. The lighting device of claim 8, wherein the sensor is slidable to change a position of the sensor assembly while the sensor housing is attached to the electrical cable.

14. The lighting device of claim 8, wherein the back cover of the luminaire housing is hidden from view from an area below that luminaire when the luminaire is suspended from a ceiling.

15. The lighting device of claim 8, wherein the sensor faces an area below the luminaire when the luminaire is suspended from a ceiling.

16. The lighting device of claim 8, wherein the sensor housing is positioned such that a light exiting the luminaire housing toward an area below the luminaire is unobstructed by the sensor housing and wherein the light is provided by a light source of the luminaire.

17. The lighting device of claim 8, wherein the sensor includes an occupancy sensor or a daylight sensor.

18. A lighting device, comprising:

a linear luminaire comprising a luminaire housing having a side panel, wherein the side panel includes an upper segment, a lower segment, and a channel between the upper segment and the lower segment; and a sensor assembly comprising a sensor housing and a sensor, that is disposed at least partially in the sensor housing, the sensor housing having an upper section and a lower section that are partially separated by a gap, wherein the sensor housing is movably attached to the side panel, by an attachment structure protruding out from a wall of the sensor housing between the upper section and the lower section and extending into the channel, and wherein the sensor housing is positioned outside of the luminaire housing.

19. The lighting device of claim 18, wherein the sensor housing is positioned laterally adjacent to the luminaire housing.

20. The lighting device of claim 18, wherein the sensor housing includes an attachment end portion positioned on a top edge of the side panel.

* * * * *